US006390859B2

(12) United States Patent
Furutani

(10) Patent No.: US 6,390,859 B2
(45) Date of Patent: May 21, 2002

(54) CONNECTOR HOUSING

(75) Inventor: Mitsugu Furutani, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/845,444

(22) Filed: Apr. 30, 2001

(30) Foreign Application Priority Data

May 24, 2000 (JP) ..... 2000-153786

(51) Int. Cl.[7] ..... H01R 13/514
(52) U.S. Cl. ..... 439/752
(58) Field of Search ..... 439/751, 595

(56) References Cited

U.S. PATENT DOCUMENTS 5,437,565 A * 8/1995 Atsumi et al. ..... 439/752
5,474,477 A * 12/1995 Aoyama ..... 439/752
5,820,421 A * 10/1998 Makino ..... 439/752
5,997,364 A * 12/1999 Matsuoka et al. ..... 439/752
6,036,552 A * 3/2000 Atsumi ..... 439/752

FOREIGN PATENT DOCUMENTS

JP 10-50382 2/1998

* cited by examiner

*Primary Examiner*—Tulsidas Patel
(74) *Attorney, Agent, or Firm*—Anthony J. Casella; Gerald E. Hespos

(57) ABSTRACT

A connector housing (11) is provided to prevent a retainer (15) from inadvertently moving from a partial locking position to a full locking position. The retainer (15) can be held in a partial locking position where the retainer (15) is located at a shallow insertion position in a hollow portion (14*a*) and permits the insertion and withdrawal of terminal fittings (T). The retainer (15) also can be in a full locking position (P3) where the retainer (15) is deeper in the hollow portion (14*a*) to lock the terminal fittings (T) so as not to come out of cavities. There are first and second partial locking positions (P1 and P2) of the retainer (15) at different depths in an inserting direction. A holding force for partially locking the retainer (15) in the housing main body (12) is set larger in the first partial locking position (P1) than in the second partial locking position (P2) before the full locking position (P3).

9 Claims, 8 Drawing Sheets

CONNECTOR HOUSING

BACKGROUND OF THE INVENTION

1. Field of the Invention

The present invention relates to a connector housing with a retainer for redundantly locking terminal fittings in the connector housing. The connector housing and the retainer are designed to prevent an inadvertent movement of the retainer to a full locking position before the terminal fittings are inserted in the connector housing.

2. Description of the Related Art

A known connector housing is identified by the numeral 1 in FIGS. 8(A) and 8(B) and also is disclosed in Japanese Unexamined Patent Publication No. 10-50382. The connector housing 1 has a housing main body 2 with cavities 3 and terminal fittings T inserted in the cavities 3. A retainer insertion opening 4 is formed in a surrounding wall of the housing main body 2 and crosses the cavities 3. A retainer 5 can be inserted into the retainer insertion opening 4 for locking the terminal fittings T in the cavities 3.

The retainer 5 is inserted in the housing main body 2 in advance and is locked in a "partial locking position" where the retainer 5 does not hinder insertion and withdrawal of the terminal fittings T. The assembled connector housing 1 and retainer 5 then are conveyed to a location where the terminal fittings T can be inserted into the cavities 3. The retainer 5 is pushed to a "full locking position" after all the terminal fittings T have been inserted into the cavities 3 to prevent withdrawal of the terminal fittings T.

A partial locking means 6 in the connector housing 1 holds the retainer 5 in the partial locking position before the terminal fittings T are inserted into the housing main body 2. However, another connector housing 1 or some other object may collide with the retainer 5 while the connector housings 1 are packed in a case and transported to the location where the terminal fittings T are inserted into the housing main body 2. Such a collision may inadvertently push the retainer 5 to the full locking position. In such a case, the retainer 5 must be pulled back to the partial locking position before the terminal fittings T can be inserted. Inadvertent movement of the retainer 5 to the full locking position can be avoided by locking the retainer 5 in the partial locking position with a stronger force. This, however, increases a burden on the operator who must manually push the retainer 5 to the full locking position after the terminal fittings T are inserted.

In view of the above problem, a protection wall 7 extends substantially to the height of the pushing portion of the retainer 5 when the retainer 5 is in the partial locking position in the connector housing 1, as shown in FIGS. 8(A) and 8(B). Thus, a direct collision with the pushing portion of the retainer 5 is less likely. However, it is still possible that a corner of another connector housing 1 or a projected part of another object may directly strike the pushing portion of the retainer 5 and inadvertently push the retainer 5 to the full locking position.

The present invention was developed to solve the above problem, and an object of the invention is to provide a connector housing in which a retainer does not inadvertently move to a full locking position even if another connector housing or external matter strikes against the retainer during transportation.

SUMMARY OF THE INVENTION

The invention is directed to a connector housing that comprises a housing main body with opposite front and rear ends and at least one cavity that extends between the ends. A terminal fitting is accommoodated in each cavity, and preferably is inserted from the rear of the housing main body. The housing main body also has a hollow portion that extends transversely through a surrounding wall of the housing main body and into communication with the cavity. A retainer can be inserted into the hollow portion and can be locked in at least first and second partial locking positions and in a full locking position. The terminal fitting can be inserted into or withdrawn from the cavity when the retainer is in either of the partial locking positions. However, the terminal fitting is locked securely in the cavity when the retainer is in the full locking position.

Each locking position represents a different depth of insertion of the retainer in the housing main body. More particularly, the retainer is at relatively shallow insertion depths for each of the partial locking positions. However, the full locking position represents a deeper insertion position for the retainer. A holding force for partially locking the retainer in the housing main body is larger in the first partial locking position than in the second partial locking position.

The holding force for holding the retainer in first partial locking position in the housing main body is set such that the retainer will not be pushed to the second partial locking position by an inadvertent collision with another connector housing or some other object during transportation. On the other hand, the holding force of the retainer in the second partial locking position is set such that the retainer can be pushed easily by hand to the full locking position. Accordingly, the retainer is prevented from moving inadvertently to the full locking position while the connector housing is transported to a location where a terminal fitting is inserted. The retainer can be moved from the first partial locking position to the second partial locking position by a pushing means of an automatic apparatus, and then can be pushed by hand to the full locking position after the terminal fittings are inserted.

The retainer may be locked in the first partial locking position by a first locking means that comprises mutually engageable locking projections and locking holes formed between side walls of the retainer and side walls of the hollow portion. The retainer also may be locked in the second partial locking position and the full locking position by a second locking means. The second locking means comprises full and partial locking projections that project from front and rear inner walls of the hollow portion in the housing main body. The full and partial locking projections can be engaged selectively with full and partial locking claws that project from the retainer for selectively locking the retainer in the full locking position and the second partial locking position. The first and second partial locking means preferably are set in different positions. Thus, the holding force for the retainer can be set stronger in the first partial locking position and weaker in the second partial locking position.

The partial locking claw of the retainer preferably contacts the partial locking projection of the housing main body when the retainer is locked in the first partial locking position by the first locking means. Thus an additional holding force is created for preventing the movement of the retainer in its inserting direction. This cooperation between the first and second locking means enables the holding force for the retainer in the first partial locking position to be even stronger.

The first locking claw no longer resists movement of the retainer when the retainer is inserted to the second partial locking position. As a result, the retainer can be pushed easily from the second partial locking position to the full locking position.

The full locking means of the retainer may contact an additional projection of the housing main body when the retainer is locked in the first partial locking position in the housing main body by the first locking means. This contact creates a supplemental holding force for preventing movement of the retainer in its inserting direction.

The holding force acting between the housing main body and the retainer to hold the retainer in the first partial locking position is set between about 50 and about 85 N, and preferably between about 60 and about 75 N. The holding force for the retainer in the second partial locking position is preferably set between about 15 and about 30 N.

These and other objects, features and advantages of the present invention will become apparent upon reading of the following detailed description of preferred embodiments and accompanying drawings.

BRIEF DESCRIPTION OF THE DRAWINGS

FIGS. 5(A) and 5(B) are a section of the connector housing when the retainer is in a first partial locking position, and a section of the connector housing taken along a direction normal to a direction along which FIG. 5(A) is taken, respectively.

FIGS. 6(A) and 6(B) are a section of the connector housing when the retainer is in the second partial locking position, and a section of the connector housing taken along a direction normal to a direction along which FIG. 6(A) is taken, respectively.

FIGS. 7(A) and 7(B) are a section of the connector housing when the retainer is in the full partial locking position, and a section of the connector housing taken along a direction normal to a direction along which FIG. 7(A) is taken, respectively.

DETAILED DESCRIPTION OF THE PREFERRED EMBODIMENT

Figure 1:
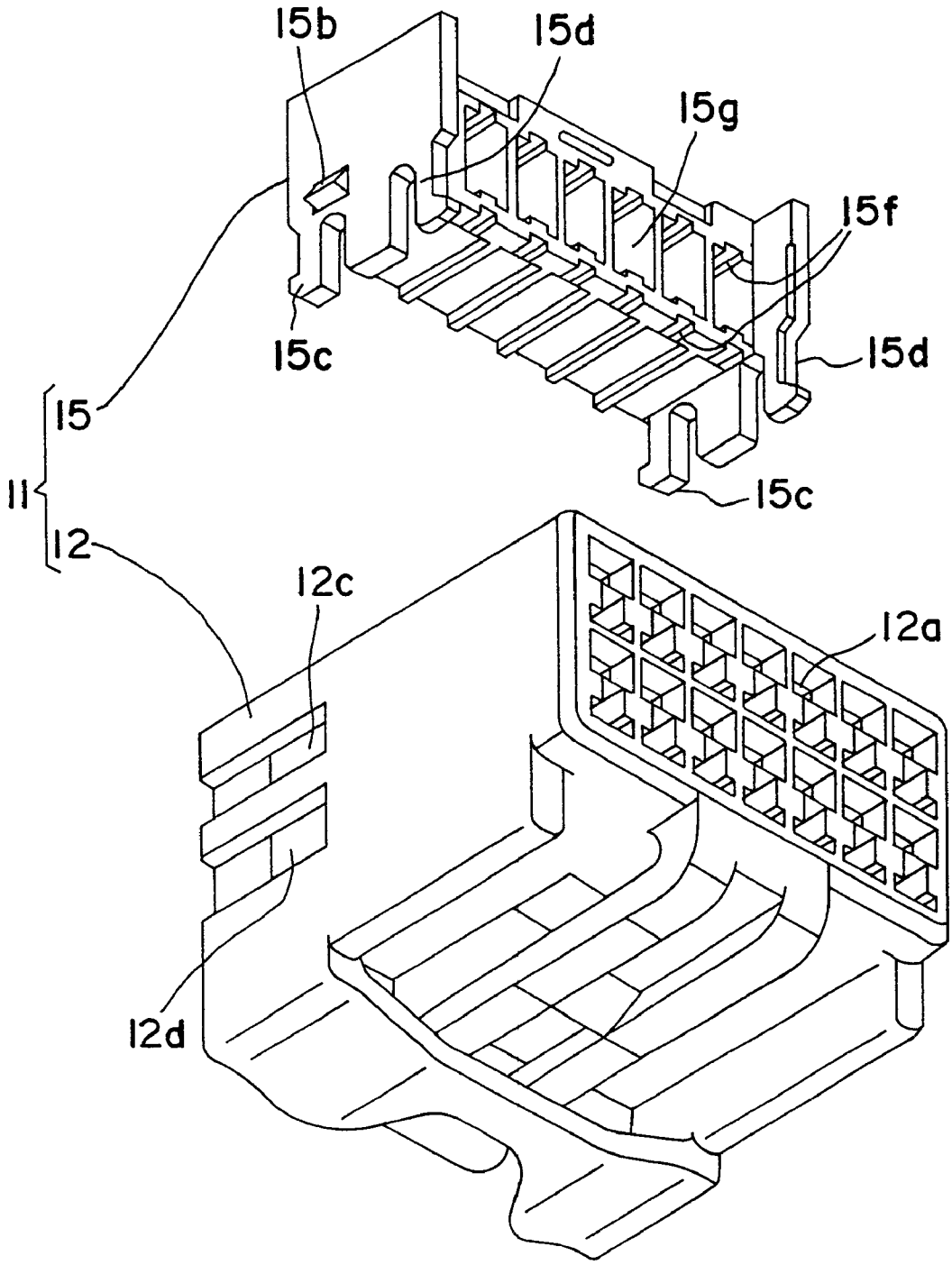
FIG. 1 is an exploded perspective view of a connector housing according to the present invention.

A connector housing in accordance with the invention is identified by the numeral 11 in FIG. 1. The connector housing 11 is made e.g. of a synthetic resin and has a housing main body 12 with opposite front and rear ends. Cavities 13 extend through the housing main body 12 from the rear end to the front end and a corresponding number of terminal fittings T are inserted into the cavities 13 from the rear. The connector housing 11 further includes a synthetic resin retainer 15 that is formed separately from the housing main body 12. The retainer 15 can be mounted in the housing main body 12 to lock the terminal fittings T in the cavities 13.

Figure 2A:
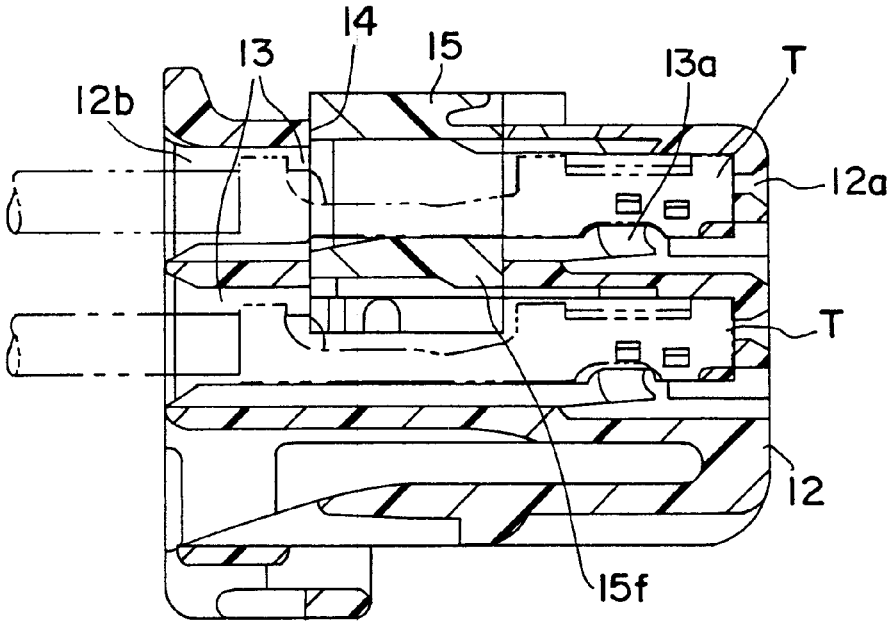
FIGS. 2(A) and 2(B) are sections showing a state where a retainer is locked in a second partial locking position and a state where the retainer is locked in a full locking position, respectively.
Figure 2B:
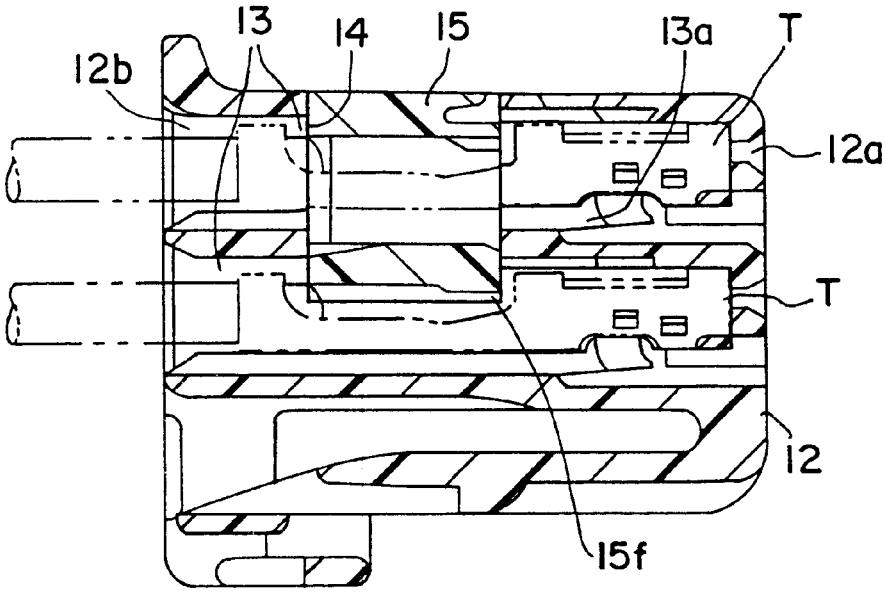

The housing main body 12 preferably is substantially box-shaped, and terminal insertion holes 12*a* extend into the front end of the housing main body 12 for receiving terminals (not shown) of a mating connector. Larger terminal insertion holes 12*b* extend into the rear end of the housing main body 12 to enable insertion of the terminal fittings T into the cavities 13. As shown in FIG. 2, a locking portion 13*a* extends obliquely to the front from a substantially middle position of the bottom wall of each cavity 13 for locking the terminal fittings T in the respective cavities 13. A leading end of each locking portion 13*a* is deformable downward or away from the cavity 13, and can be engaged elastically with a locking hole Ta in the corresponding terminal fitting T. A locked state of the terminal fitting T achieved by the locking portion 13*a* is referred to as partial locking. However, a locked state of the terminal fitting achieved by the retainer 15 is referred to as full locking; and a connector having these two locked states is referred to as a double locking connector.

Figure 3:
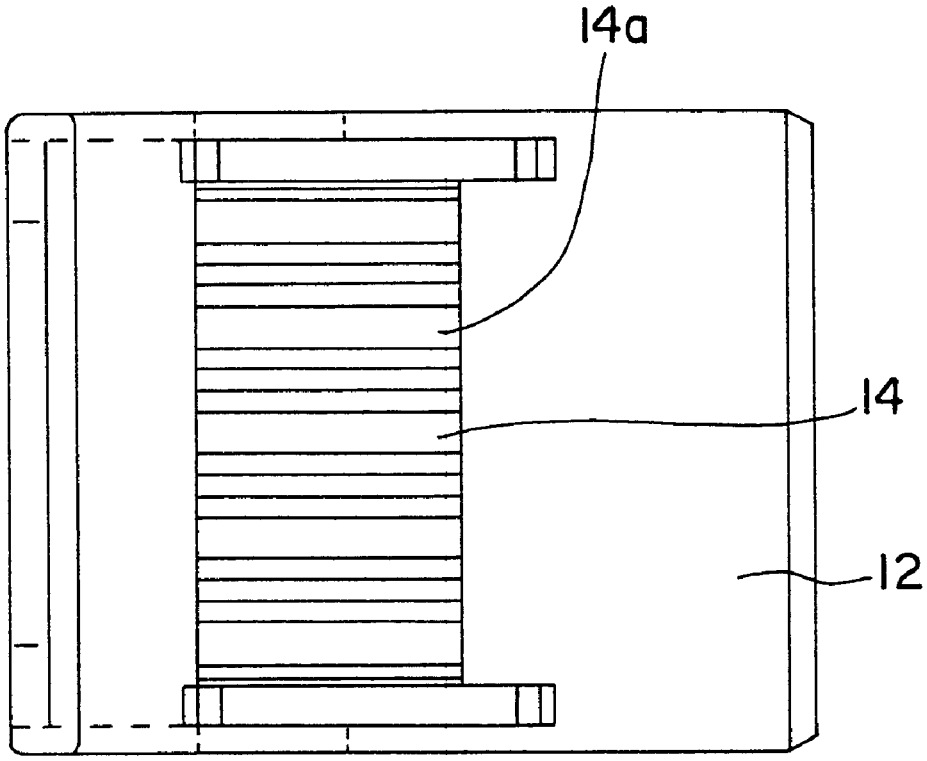
FIG. 3 is a plan view of a housing main body.

As shown in FIG. 3, a retainer insertion opening 14 is open in one surface of a surrounding wall of the housing main body 12, and a hollow portion 14*a* intersects and communicates with the cavities 13.

Figure 4A:
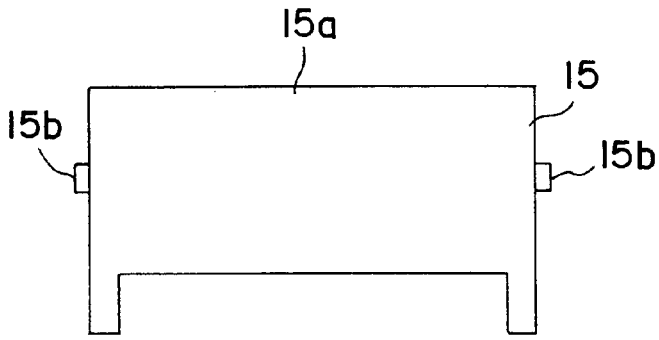
FIGS. 4(A), 4(B) and 4(C) are a plan view, a front view and a side view of the retainer.
Figure 4B:
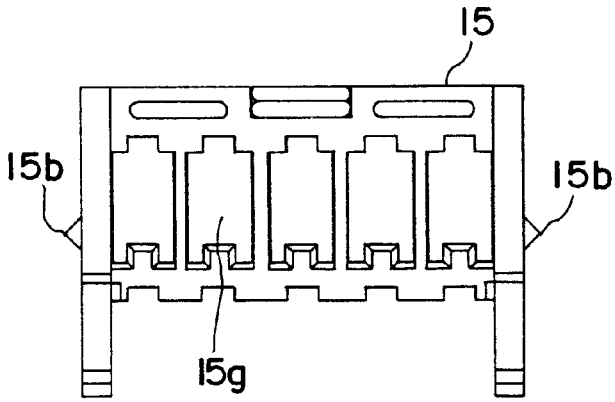
Figure 4C:
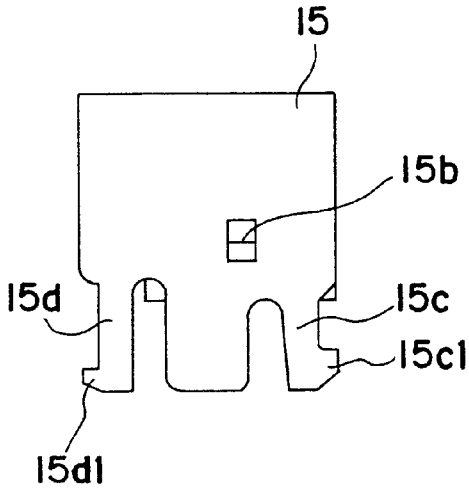

The retainer 15, as shown in FIGS. 4(A) to 4(C), is a lattice-shaped frame with terminal insertion paths 15*g* that correspond to the respective cavities 13 of the housing main body 12, and is configured for insertion into the hollow portion 14*a* of the retainer insertion opening 14 in the housing main body 12. The retainer 15 can be locked in three positions having different depths of insertions, namely, a first partial locking position P1 (see FIG. 5), a second partial locking position P2 (see FIG. 6) and a full locking position P3 (see FIG. 7), which is a completely inserted position. In the full locking position P3, a pushing surface 15*a* of the retainer 15 is substantially flush with the outer surface of the housing main body 12.

The retainer 15 is held in the first partial locking position P1 in the housing main body 12 by a first locking means A. The first locking means A comprises locking projections 15*b* that project from the opposite side walls of the retainer 15 and locking holes 12*c* in side walls of the housing main body 12 adjacent the hollow portion 14*a* . The locking projections 15*b* and the locking holes 12*c* are dimensioned to be engaged with one another. Additionally, the upper and lower surface of the locking projections 15*b* are slanted. The side walls of the housing main body 12 have escape holes 12*d* for avoiding interference with the locking projections 15*b* when the retainer 15 is inserted to the second partial locking position P2 or the full locking position P3, thereby removing a restriction on the movement of the retainer 15 in these positions.

Figure 6A:
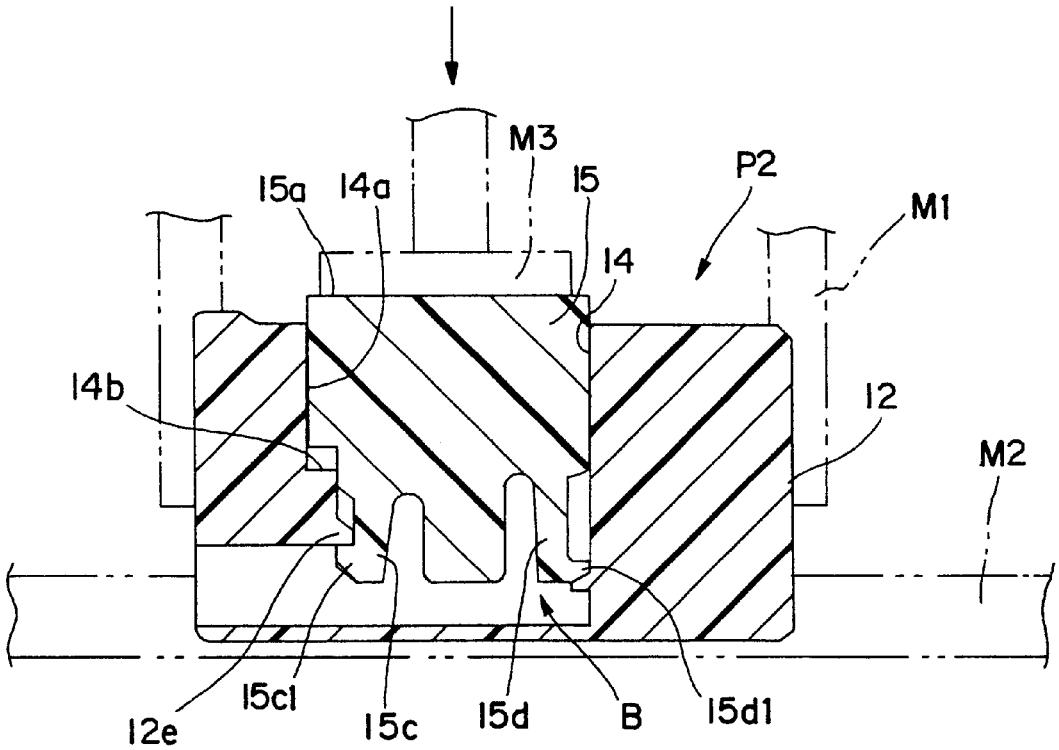
Figure 7A:
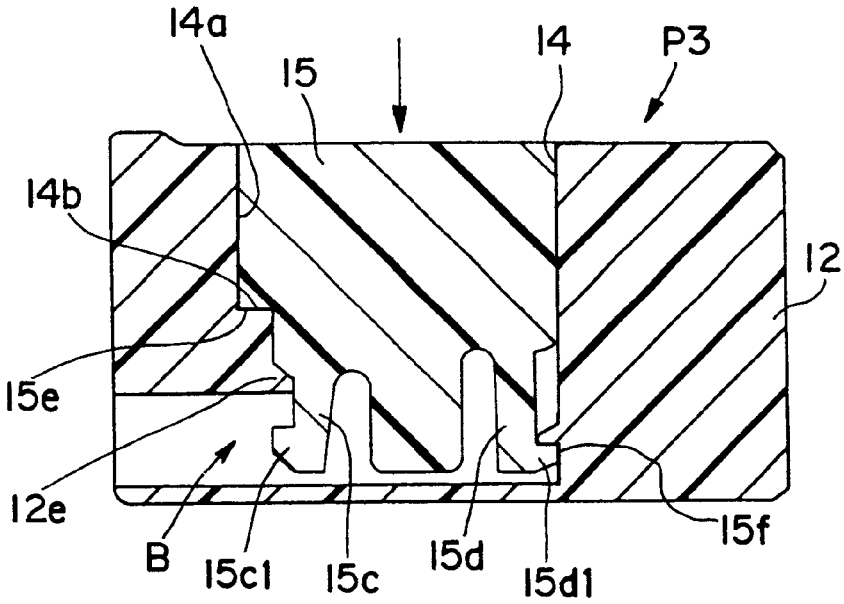
Figure 7B:
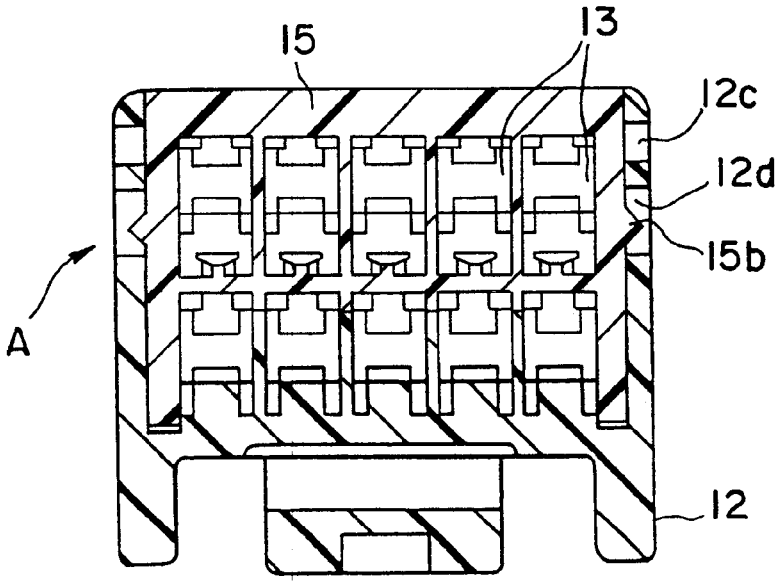
Figure 8A:
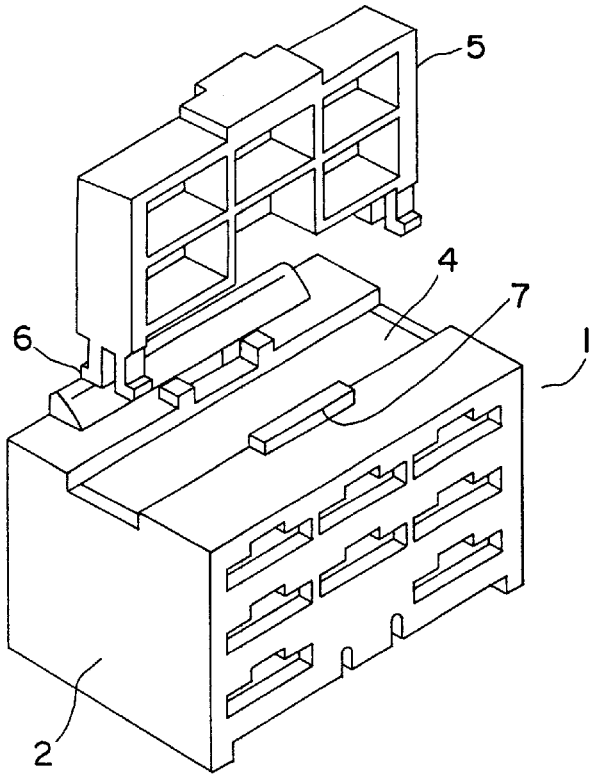
FIG. 8(A) PRIOR ART
FIGS. 8(A) and 8(B) are diagrams showing a prior art connector housing.
Figure 8B:
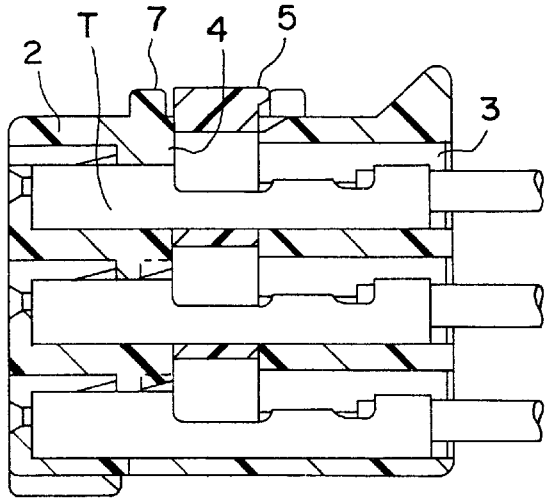
FIG. 8(B) PRIOR ART

The retainer 15 is held in the second partial locking position P2 and the full locking position P3 in the housing main body 12 by a second locking means B. The second locking means B comprises a partial locking projection 12*e* and a full locking projection 12*f* that project at different depths on the front and rear wall surfaces of the hollow portion 14*a*. The second locking means B also comprises a partial locking claw 15*c*1 and a full locking claw 15*d*1 which project from the leading ends of flexible arms 15*c*, 15*d*, respectively. The flexible arms 15*c*, 15*d* extend in an inserting direction at front and back positions of the opposite side walls of the retainer 15, and the locking claws 15*c*1 and 15*d*1 project from the flexible arms 15*c*, 15*d* in directions to face the locking projections 12*e*, 12*f*. The partial and full locking projections 12*e*, 12*f* each have a flat lower surface and a slanted upper surface. On the other hand, the partial and full locking claws 15*c*1, 15*d*1 have a slanted lower surface and a flat upper surface. As shown in FIG. 6(A), the flat surface of the partial locking claw 15c1 can engage the flat surface of the partial locking projection 12e in the second partial locking position P2 to restrict withdrawal of the retainer 15. Further, as shown in FIGS. 7(A) and 7(B), the flat surfaces of the full locking claw 15d1 and the full locking projection 12f are engaged to restrict withdrawal of the retainer 15. Movement of the retainer 15 in its pushing direction is restricted by the contact of stepped portions 14b and 15e, as shown in FIG. 7(A).

The slanted surface of the partial locking claw 15c1 of the second locking means B contacts the slanted surface of the partial locking projection 12e (FIG. 5) at substantially the same time that the locking projections 15b of the first locking means A engage the locking holes 12c to lock the retainer 15 in the first partial locking position P1. Thus, a holding force is created and restricts movement of the retainer 15 in its inserting direction. As a result, the holding force of the retainer 15 in the first partial locking position P1 is larger than in the second partial locking position P2. Additionally, at the same time the locking projections 15b of the first locking means A engage the locking holes 12c to lock the retainer 15 in the first partial locking position P1, the slanted surface of the full locking claw 15d1 of the second locking means B may contact the slanted surface of an additional projection in the hollow portion 14a of the housing main body 12, as shown in broken lines in FIG. 5(A). This latter contact may occur at a location before the full locking projection 12f when seen in the insertion direction of the retainer 15. Thus, a holding force is created and restricts movement of the retainer 15 in its inserting direction. The holding force of the retainer 15 in the first partial locking position may be increased by, e.g. increasing the projecting height of the locking projections 15b of the first locking means A or flattening the inclination of the slanted upper surfaces.

The holding force between the housing main body 12 and the retainer 15 to hold the retainer 15 in the first partial locking position P1 is set at a strength (60 to 75 N) to prevent the retainer 15 from being pushed inadvertently to the second partial locking position P2 due to a collision with another connector housing or with some other object during transportation of the connector housings 11. On the other hand, the holding force of the retainer 15 in the second partial locking position P2 is set at a lower strength (15 to 30 N) so that the retainer 5 can be pushed easily to the full locking position P3 by hand.

Figure 5A:
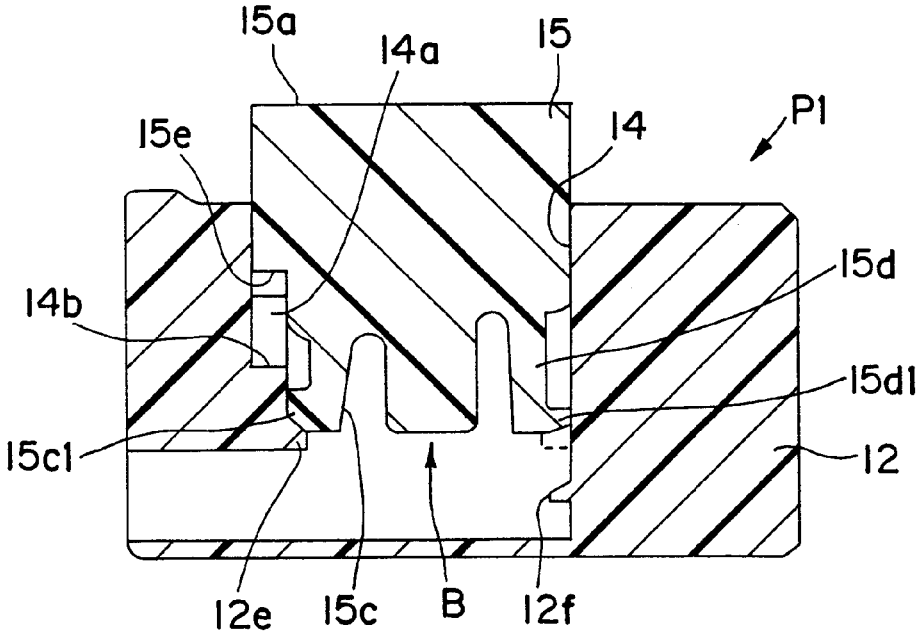
Figure 5B:
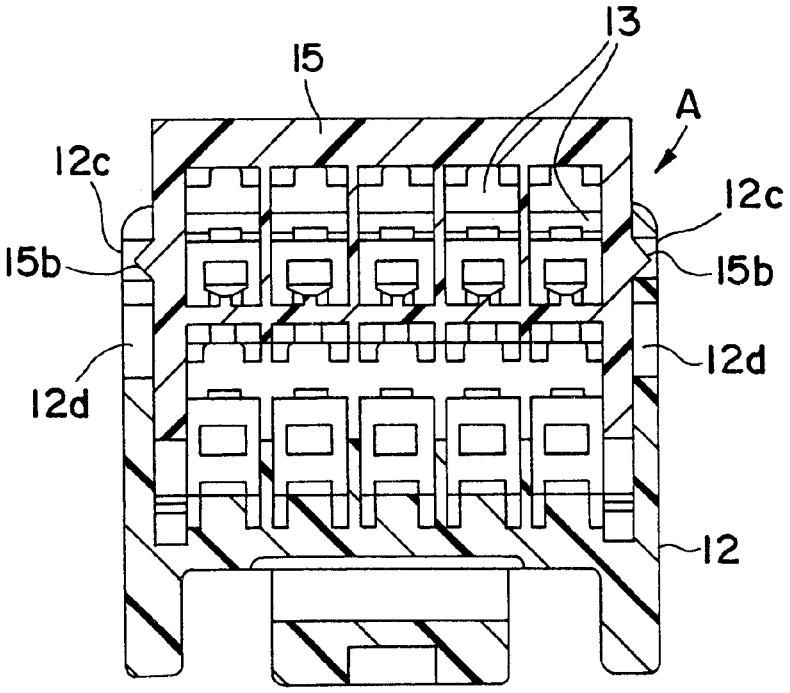

The retainer 15 is inserted through the retainer insertion opening 14 and into the hollow portion 14a to start the assembly of the connector housing 11. Sufficient insertion enables the retainer 15 to be held in the first partial locking position P1, as shown in FIGS. 5(A) and 5(B). The connector housings 11 then are packed in a box for transport to a wiring harness assembling location. In the first partial locking position P1, the partial locking claw 15c1 contacts the partial locking projection 12e and strongly resists movement of the retainer 15 in the inserting direction. This contact occurs substantially at the same time that the locking projections 15b engage the locking holes 12c.

Figure 6B:
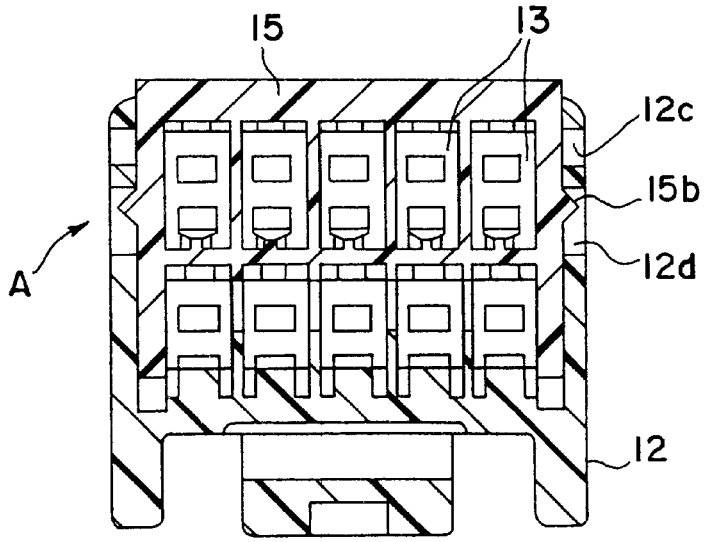

Assembly proceeds by providing terminal fittings T connected with ends of wires and inserting the terminal fittings T into the cavities 13 of the connector housing 11. More particularly, the connector housings 11 are aligned on a palette M2, gripped by a holder M1 and set at specified positions for insertion of the terminal fittings T by an automatic assembling apparatus. Pushing forces on the portion M3 of the holder M1 pushes the retainer 15 mechanically from the first partial locking position P1 to the second partial locking position P2. The pushing stroke equals the distance between the first and second partial locking positions P1 and P2 to prevent the retainer 15 from being pushed straight to the full locking position P3. The pushing operation deforms the flexible arm 15c sufficiently for the partial locking claw 15c1 to move over the partial locking projection 12 and to reach the second partial locking position. The flexible arm 15d contacts the full locking projection 12f, as shown in FIGS. 6(A) and 6(B), and positions the retainer 15.

The holder M1 of the automatic assembly apparatus (not shown) inserts terminal fittings T into the corresponding cavities 13 of the connector housing 11 to form a subassembly. The subassembly then is arranged manually on a harness-assembling table and is bundled together with a subassembly formed in another process. At this stage, the terminal fittings T on the ends of wires of the other subassembly are inserted by hand. The manual insertion of the other terminal fittings T is performed after the terminal fittings T are inserted into the connector housings 11 by the automatic assembling apparatus. The retainer 15 is held in the second partial locking position P2 at this stage of the assembly. After all the necessary terminal fittings T are inserted, the retainer 15 is pushed manually to the full locking position.

The retainer 15 can be pushed lightly from the second partial locking position P2 to the full locking position P3 when the terminal fittings T are in the cavities 13. These small pushing forces deform the flexible arm 15d sufficiently to cause the full locking claw 15d1 to move over the full locking projection 12f, as shown in FIGS. 7(A) and 7(B) to effect full locking.

The first locking means A is set in a separate position for locking the retainer 15 in the first partial locking position P1. However, the first locking means A may be constructed by providing a projection substantially in the same position as the second partial locking means B, i.e. in a position where the partial locking projection 12e and the full locking projection 12f are formed.

As is clear from the above description, the holding force for partially locking the retainer in the housing main body is larger in the first partial locking position than in the second partial locking position. Thus, the retainer is prevented from inadvertently moving to the full locking position due to a collision with another connector housing or with external matter during the transportation. Therefore, a cumbersome operation of pulling an inadvertently pushed retainer from the full locking portion back to the partial locking position needs not be performed in the wiring harness assembling process.

What is claimed is:

1. A connector housing, comprising:

at least one cavity for accommodating at least one terminal fitting, a housing main body having a hollow portion intersecting the cavity, and a retainer configured for locking in first and second partial locking positions in the hollow portion, the retainer being configured to permit insertion and withdrawal of the terminal fitting into and out of the cavity when the retainer is in the first and second partial locking positions, the retainer further being configured for insertion to a full locking position where the retainer is deeper in the hollow portion than in the first and second partial locking positions to lock the terminal fittings in the cavities, wherein the retainer and the housing main body are configured such that a force for resisting movement of the retainer from the first partial locking position to the second partial locking position is larger than a force resisting movement of the retainer from the second partial locking position to the full locking position.

2. The connector housing of claim 1, wherein the connector housing has opposite front and rear ends, the terminal fittings being configured for insertion into the rear end of the connector housing.

3. The connector housing of claim 1, wherein the hollow portion extends through a surrounding wall of the housing main body.

4. A connector housing, comprising:

at least one cavity for accommodating at least one terminal fitting;

a housing main body having a hollow portion intersecting the cavity, and a retainer configured for locking in first and second locking positions in the hollow portion, the retainer being configured to permit insertion and withdrawal of the terminal fitting into and out of the cavity when the retainers is in the first and second partial locking positions, the retainer further being configured for insertion to a full locking position where the retainer is deeper in the hollow portion than in the first and second partial locking positions to lock the terminal fittings in the cavities, wherein the retainer and the housing main body are configured such that a holding force for resisting movement of the retainer from the first partial locking position to the second partial locking position is larger than a holding force for resisting movement of the retainer from the second partial locking position to the full locking position, and wherein the retainer is configured to be locked in the first partial locking position in the housing main body by a first locking means comprising at least one locking projection on the retainer and at least one locking hole formed on a side wall of the hollow portion.

5. The connector housing of claim 4, wherein the retainer is configured to be locked in the second partial locking position and full locking position in the housing main body by a second locking means comprising full and partial locking projections projecting from front and rear inner walls of the hollow portion in the housing main body and corresponding full and partial locking claws projecting from the retainer for selective engagement with the full and partial locking projections in the full locking position and the second locking position.

6. The connector housing of claim 5, wherein, when the retainer is locked in the first partial locking position in the housing main body by the first locking means, the partial locking claw of the retainer contacts the partial locking projection of the housing main body to create a supplemental holding force for preventing the movement of the retainer in its inserting direction.

7. The connector housing of claim 6, wherein the first locking means removes a restriction on movement of the retainer when the retainer is inserted to the second partial locking position.

8. The connector housing of claim 5, wherein, when the retainer is locked in the first partial locking position in the housing main body by the first locking means, the full locking claw of the retainer contacts an additional projection of the housing main body to create a supplemental holding force for preventing movement of the retainer in the inserting direction.

9. The connector housing of claim 1, wherein the holding force between the housing main body and the retainer to hold the retainer in the first partial locking position is set at a strength between about 50 and about 85 N, while the holding force for the retainer in the second partial locking position is set at a strength between about and about 15 and about 30 N.

* * * * *